United States Patent [19]

Overholt

[11] Patent Number: 4,555,092

[45] Date of Patent: Nov. 26, 1985

[54] SYSTEM FOR OPERATION OF A DIRECT DRIVE DUAL DRUM WINCH

[76] Inventor: Mark Overholt, 6867 Wooster Pike, Medina, Ohio 44256

[21] Appl. No.: 498,787

[22] Filed: May 27, 1983

[51] Int. Cl.[4] ..... B66D 1/08

[52] U.S. Cl. ..... 254/291; 60/444; 254/282; 254/315; 254/377

[58] Field of Search ..... 254/280, 281, 282, 291, 254/294, 315, 325, 328, 377, 361; 60/905; 445, 443, 444; 417/219, 222; 212/160

[56] References Cited

U.S. PATENT DOCUMENTS

| | | | |
|---|---|---|---|
| 1,139,944 | 5/1915 | Wilson et al. | 254/315 X |
| 2,316,926 | 4/1943 | Willett | 254/315 X |
| 2,643,093 | 6/1953 | Province | 254/329 |
| 2,943,511 | 8/1960 | Wilson | 254/328 |
| 3,462,125 | 8/1969 | Gollwitzer et al. | 254/361 X |
| 3,750,406 | 8/1973 | Verlinde et al. | 60/443 X |
| 4,078,667 | 3/1978 | Navarro | 212/160 X |
| 4,194,867 | 3/1980 | Bragg | 212/160 X |
| 4,432,532 | 2/1984 | Overholt | 254/291 |

*Primary Examiner*—Stuart S. Levy
*Assistant Examiner*—Katherine Jaekel
*Attorney, Agent, or Firm*—Mack D. Cook, II

[57] ABSTRACT

For use in service and maintenance of oil and gas (or water) wells, a system for operating a truck mounted direct drive dual drum winch. Each drum is independently driven by a direct coupled radial piston hydraulic motor. The system includes an improved source of hydraulic power connected to the drum motors through improved piping and valving for selection of drum functions (raise or hoist, lower or drop, or free fall). The system also includes an improved control panel, movable and positionable by the operator for precise and safe control of selected drum functions using pneumatic power.

5 Claims, 6 Drawing Figures

SYSTEM FOR OPERATION OF A DIRECT DRIVE DUAL DRUM WINCH

CROSS-REFERENCE TO A RELATED APPLICATION

The present invention relates to a system and components thereof for operating a direct drive dual drum line and cable winch as described and claimed in U.S. Pat. No. 4,432,532, February, 1984, Overholt.

BACKGROUND OF THE INVENTION

The present invention was made to improve the operation and use of a hydraulically powered direct drive dual drum line and cable winch mounted on the deck of a mobile well tending rig, as shown in U.S. Pat. No. 4,432,532, February, 1984, Overholt. The invention enables an operator using the dual drum winch to selectively, precisely and safely raise and lower a "sandline" and a "tubing cable" elevated by a mast above a working well producing oil and gas (or water), for routine maintenance and service.

At present, the inventor has no knowledge of any prior art patents which could, alone or in combination, defeat novelty of the invention. It is assumed that prior art patents developed during examination of U.S. Pat. No. 4,432,532 will be considered during examination of this application.

SUMMARY OF THE INVENTION

It is an object of the invention to provide an improved system and components thereof for operation and use of a hydraulically powered direct drive dual drum line and cable winch mounted on the deck of a mobile well tending rig.

It is a further object of the invention to provide a system which includes an improved source of hydraulic power connected to the drum motors through improved piping and valving for selection of drum functions (raise or hoist, lower or drop, or free fall).

Still further, it is an object of the invention to provide an improved control panel, movable and positionable by the operator for precise and safe control of selected drum functions using pneumatic power.

A general object of the invention is to provide the well tending art with a control system for a truck mounted dual drum winch with components and a construction relatively low in cost, easy to service and maintain in the field, not easily damaged, and fully capable of use in any weather or environmental conditions.

These and other objects of the invention will become apparent in view of the drawings and detailed descriptions.

A system according to the invention is intended for operation and use of a hydraulically powered direct drive drum line and cable winch mounted on the deck of a mobile well tending rig.

The winch has a generally rectangular frame with a drive side plate and a parallel second side plate. Front and rear winch drums are positioned within the frame transversely of the side plates. Each drum has a shaft rotatably mounted within a second side plate and a drive shaft rotatably mounted within and projecting substantially beyond a drive side plate. Front and rear bell housings are positioned coaxially around each drum drive shaft. The outer end of each bell housing is adapted for mounting a hydraulic motor. Each front and rear hydraulic motor has radial pistons and an axially oriented inwardly projecting drive shaft aligned with a drum drive shaft. Front and rear couplings connected the aligned drive shafts within the bell housing.

In general, an improved system according to the invention is for operation and use of a dual drum line and cable winch mounted for use as a mobile well tending rig. Each drum is driven by a direct connected hydraulically powered motor.

Hydraulic fluid under pressure is supplied from a variable displacement, axial piston, reversing swashplate hydraulic pump unit powered by an engine.

A first actuator controls the horse power transmitted from the engine to the pump unit.

A second actuator controls the tilt angle and tilt direction of the swashplate in the pump unit.

Dual fluid supply or exhaust piping runs from the pump unit toward the dual drum drive motors.

A network of piping, with two pairs of open or closed fluid control valves, communicates with the dual fluid supply or exhaust piping. The network has two pairs of pipes. Each pipe pair connects both of the fluid supply or exhaust pipes to one of the drum drive motors through one pair of the open or closed fluid control valves.

There are two-position control means for actuating all of the open or closed network control valves in unison so that as the pair of control valves in one pipe pair are being opened, the pair of control valves in the other pipe pair are being closed, or vice versa.

The dual fluid supply or exhaust piping is cross-connected through a lateral pipe section before reaching the two network pairs or pipe. The lateral pipe section has an open or closed fluid control valve. There is also a two-position control means for opening or closing the lateral pipe section control valve.

There is a first remote control means for the first actuator (pump fluid pressure) and a second remote control means for the second actuator (pump fluid direction and velocity).

A user of the system can select either of the drum drive motors to be powered by movement of the two-position control means for actuating all of the network control valves in unison. A user can also control the direction and speed of rotation for the selected drum drive motor by the second remote control means. A user can also control the power output from the selected drum drive motor by said first remote control means. And, the user can free fall the drum connected to the selected drum drive motor by movement of the two-position control means for opening or closing the lateral pipe section control valve.

THE DRAWINGS

Figure 4A:
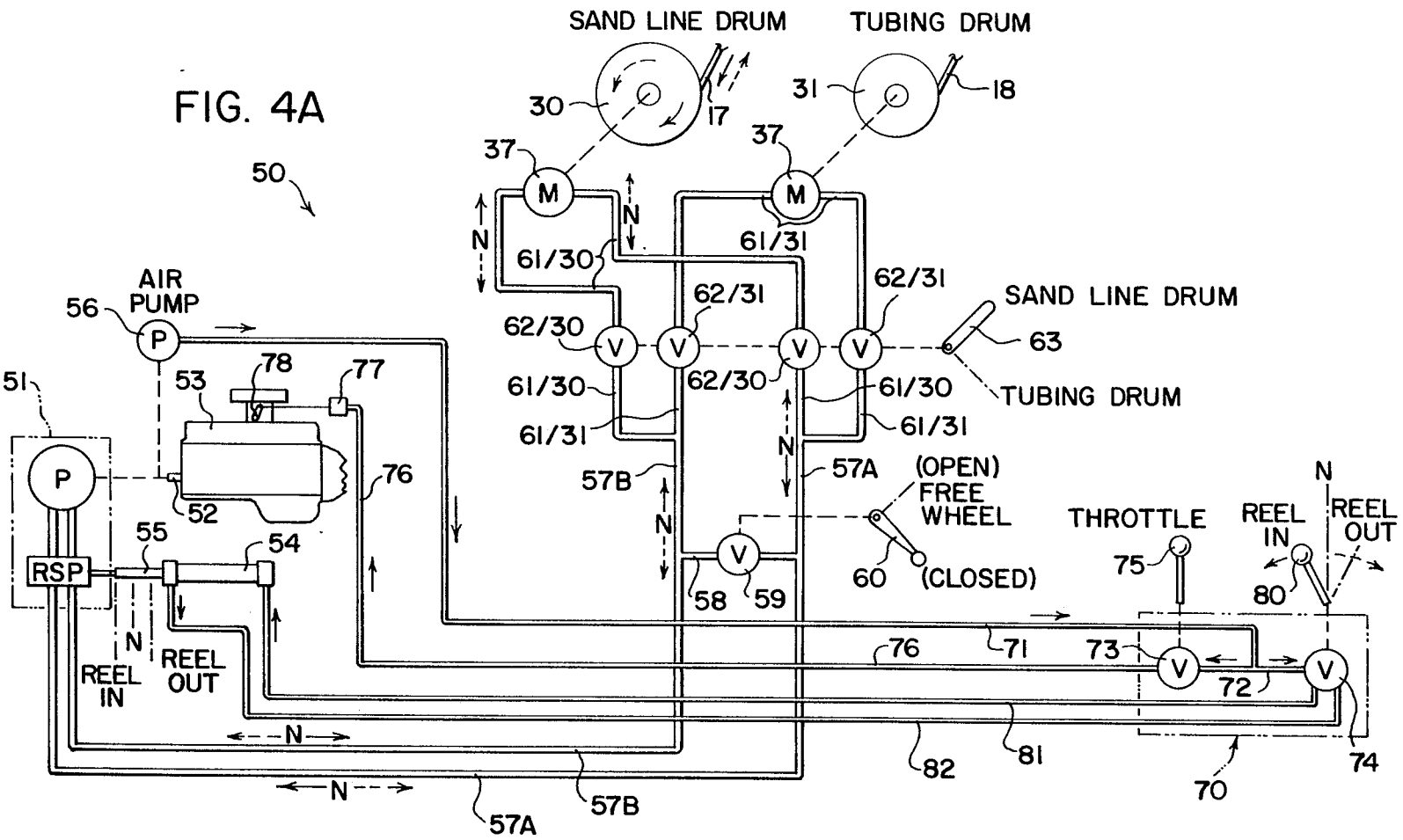
Figure 4B:
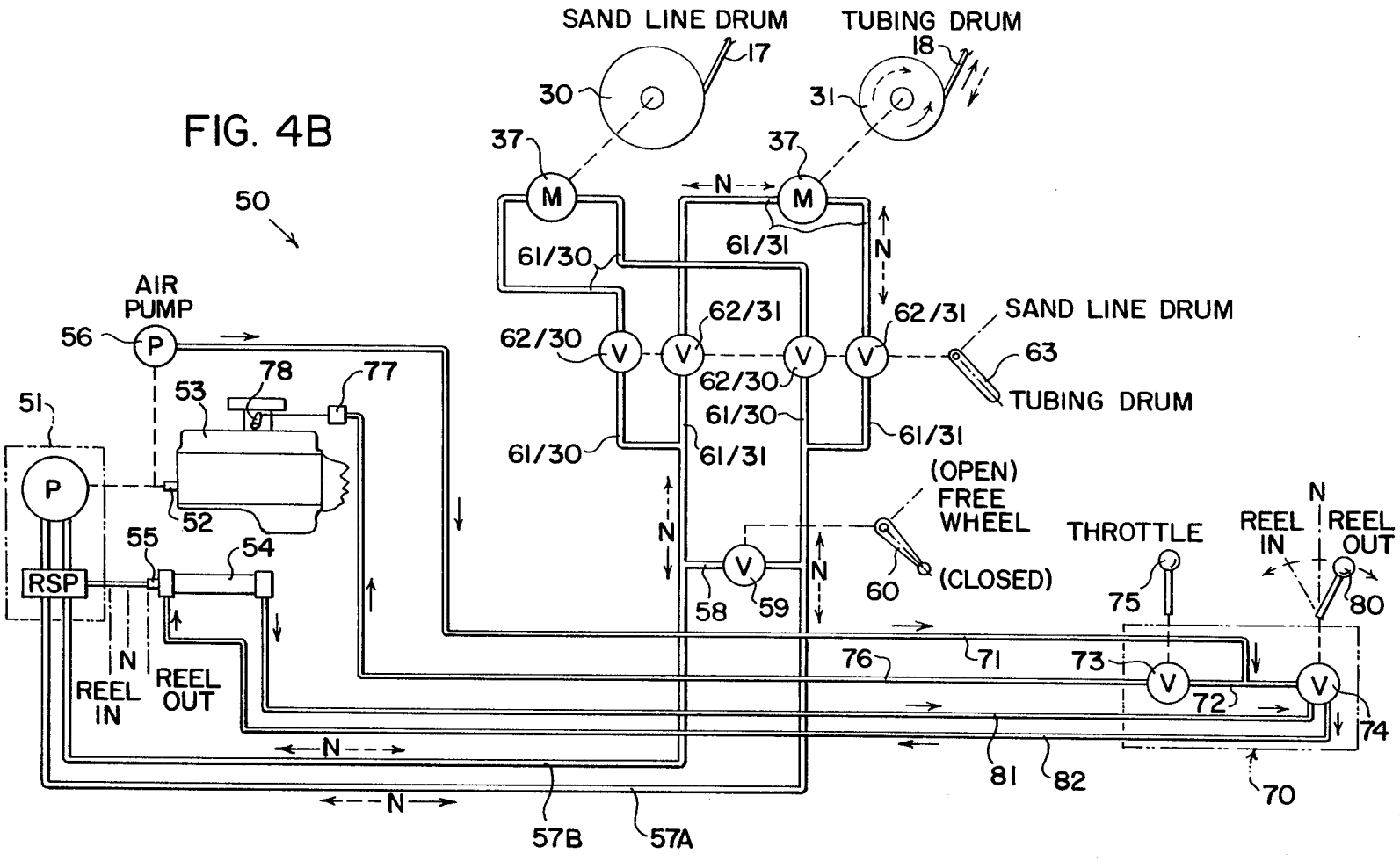
Figure 4C:
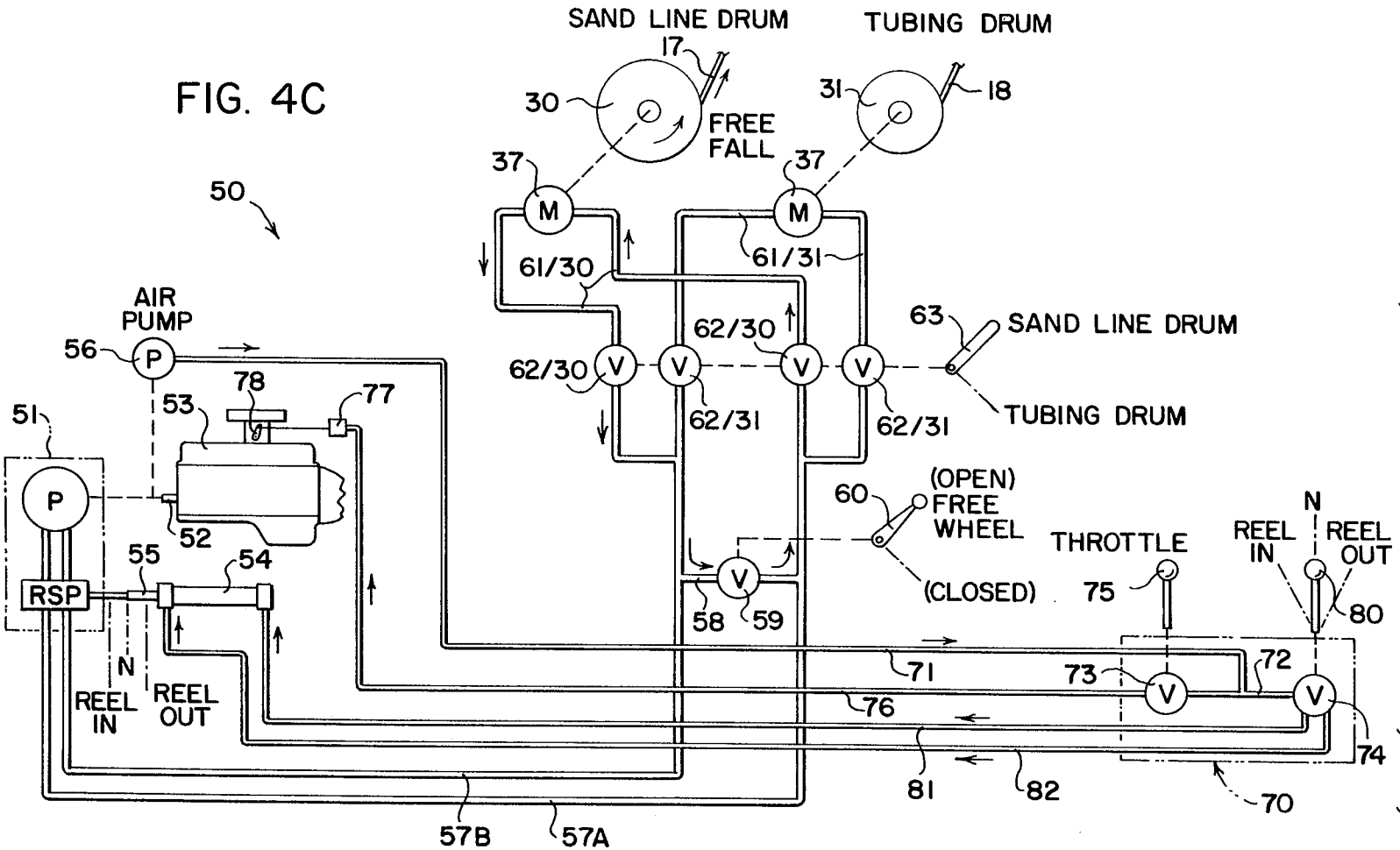

and, FIGS. 4A, 4B and 4C are related schematic views showing operating and use of the system according to the invention for selected drum functions.

DESCRIPTION OF THE INVENTION

Figure 1:
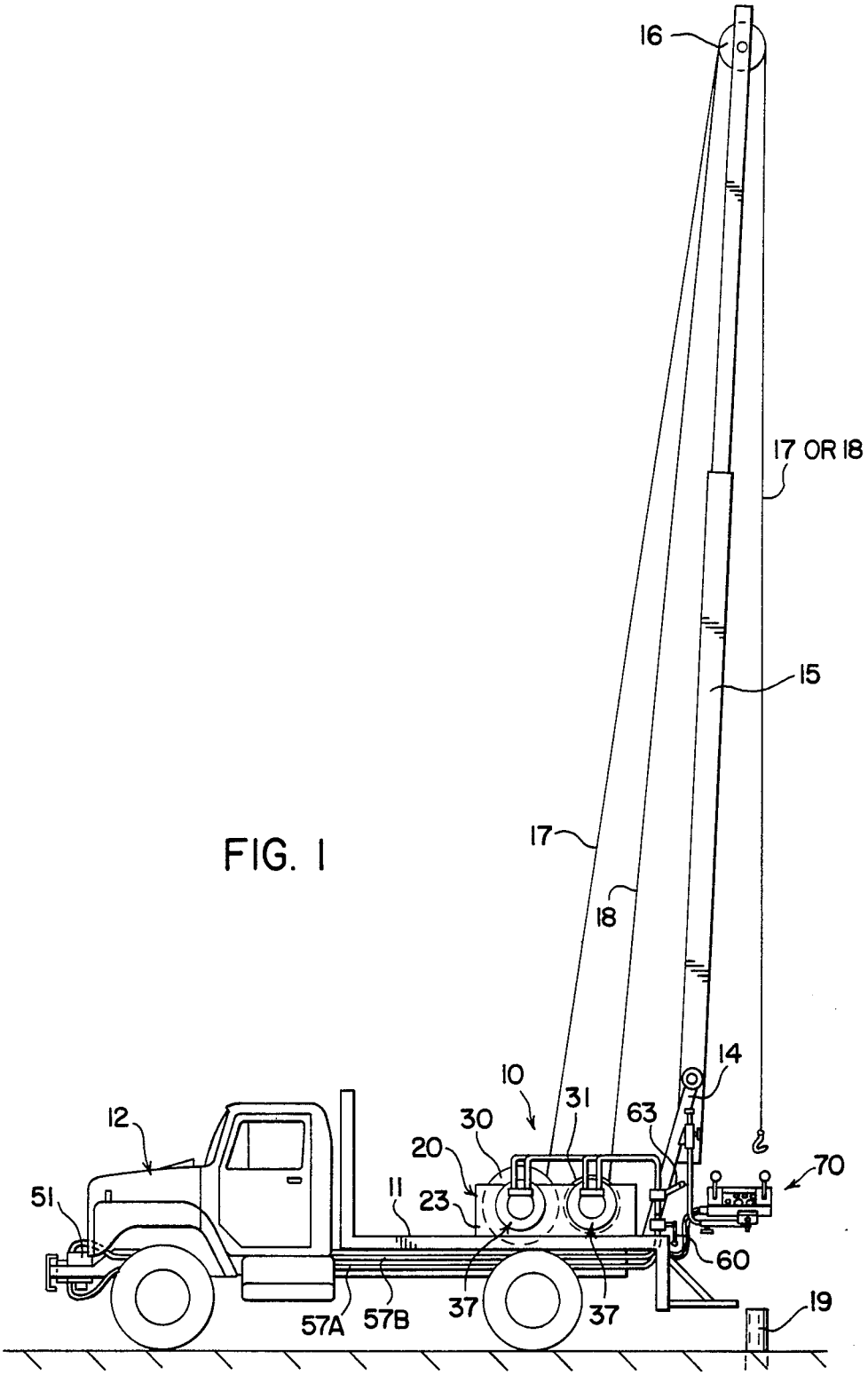
FIG. 1 is a side view of a truck mounted direct drive dual drum winch with a system and components thereof, according to the invention, ready for operation and use.
Figure 2:
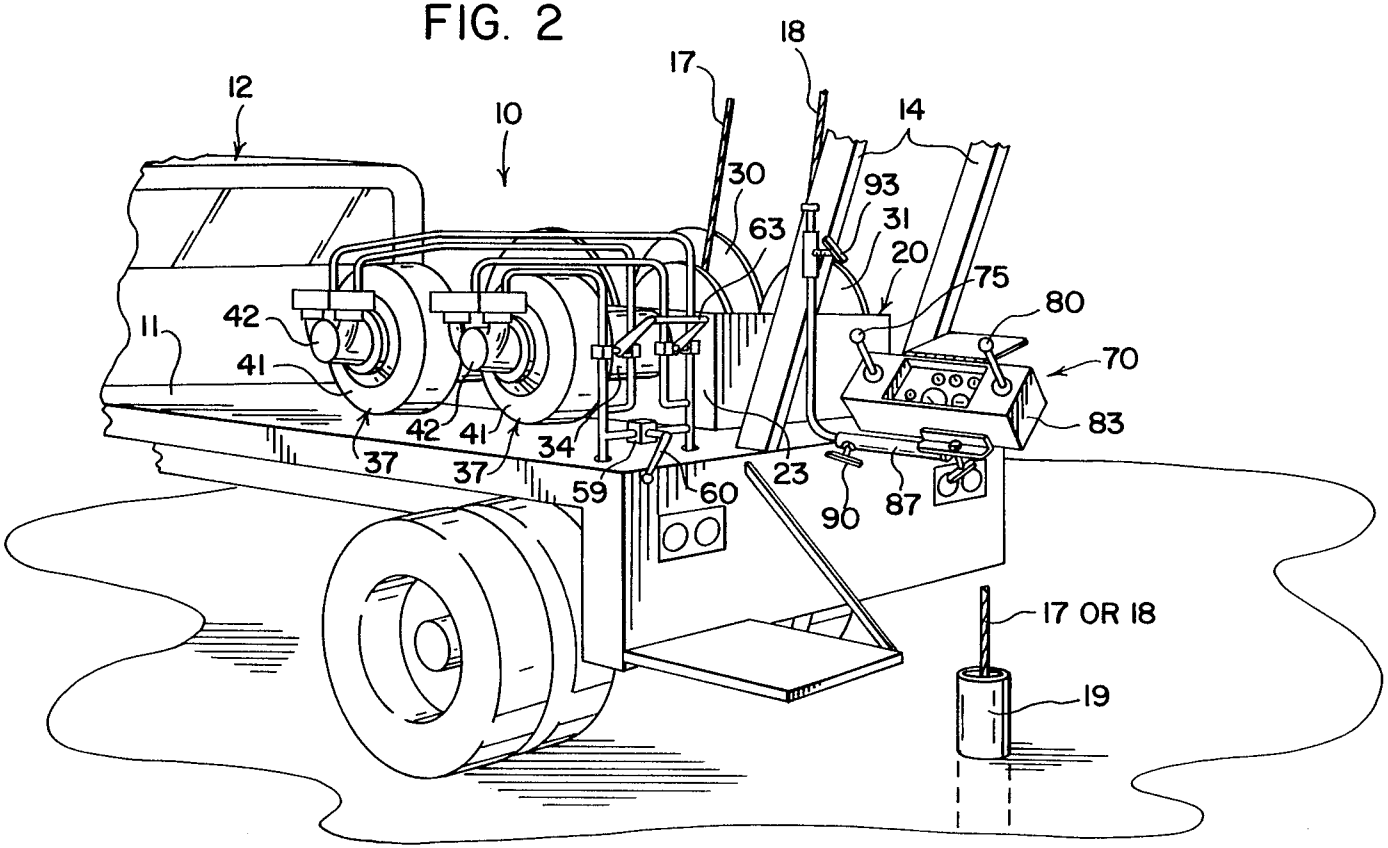
FIG. 2 is an enlarged view of the rear and deck of the truck in FIG. 1.

A direct drive dual drum line and cable winch, for operation and use by the system and components thereof according to the invention, is referred to generally by the numeral 10. Referring to FIGS. 1 and 2, a winch 10 is securely mounted on a medial portion of the deck 11 of a truck 12. A stanchion 14 attached to the rear portion of the deck 11 carries a raisable and extendible well tending mast 15. The end of the mast 15 carries rotatable crown sheeves 16 for positioning a "sand line" 17 and a "tubing cable" 18 above the casing 19 of a well requiring maintenance or repair.

As generally shown in FIGS. 1 and 2, and as shown in full detail in U.S. Pat. No. 4,432,532, February, 1984, Overholt, the winch 10 has a generally rectangular welded frame indicated at 20.

A frame 20 has a drive or first side plate 23 and a parallel second or idle sideplate (not shown). The front winch drum 30 for the "sand line" 17, and the rear winch drum 31 for the "tubing cable" 18, are positioned within the frame 20 transversely of the side plate 23. Each winch drum has an axle shaft rotatably mounted substantially within a bearing on the second side plate. Each winch drum also has a drive shaft rotatably mounted within and axially projecting substantially beyond a bearing on the drive side plate 23.

Front and rear generally cylindrical bell housings 34 are positioned coaxially around the front and rear drive shafts for protection thereof from damage. Each bell housing has an outer end adapted for mounting a hydraulic motor. Each hydraulic motor 37 has radial pistons for producing a high torque output through an axially inwardly projecting drive shaft rotated at a relatively low speed.

By way of a general description, in a suitable motor 37 drive shaft torque is generated by hydraulic thrust on an eccentric. There is no metal-to-metal contact between piston and crankshaft which provides for high starting torque and low volumetric losses. A crankshaft with integral eccentric is journalled in large capacity tapered roller bearings on each side of the main housing 41 which has five or ten radially disposed cylinders. Fluid is directed to and from the crankshaft through a distributor sleeve which is housed inside a distributor housing 42 having feed and return piping lines connected to a truck mounted hydraulic pump, as hereinafter described. The inlet and outlet ports in the crankshaft are sealed by an annular groove and sealing ring element. Axial oilways in the crankshaft connect with two accurately machined ports in the eccentric, which carries a pentagon. On each of the five faces of the pentagon, rides a hollow piston through which oil flows to and from each cylinder. All hydraulic loads are balanced by a floating pressure ring seal arrangement which mates with the inner face of each piston. The thrust of the high pressure column of fluid is then transmitted direct to the eccentric.

Within a bell housing 34, the drive shaft of each hydraulic motor 37 is operatively connected to the aligned drive shaft of a winch drum, 30 or 31, by a coupling. The couplings should be a flexible device, for connecting the rotating shafts end to end.

The system and components therefor for operation and use of the dual drum winch 10 are referred to generally by the numeral 50. Referring to the schematic views, FIGS. 4A–C, the hydraulic power source in the system 50 is a pump unit indicated at 51 (shown within chain lines). A pump unit 51 is mounted on the front of the truck 12, below the bumper; for connection to a PTO 52 on the truck engine 53.

A suitable hydraulic pump unit 51 is known in the art of hydrostatic transmissions as a variable displacement, axial piston, reversing swashplate pump. The axial piston pump P will create a constant volume of fluid under pressure, as a function of the power output of the engine PTO 52. The reversing swashplate RSP varies the output flow or displacement of fluid under pressure from the pump unit 51 into the piping of the system 50 and toward the drive motors 37.

In the known pump unit 51, the tiltable swashplate RSP is mounted on trunnion bearings and is connected to hydraulic control servo cylinders. A projecting control handle directs fluid internally of the pump unit 51, to and from the servo cylinders, for selectively tilting the swashplate in either direction from zero angle. The direction of swashplate tilt controls the direction of fluid flow from the pump unit 51 into the system piping, determining the direction of rotation of the drum drive motors 37. When the tilt plate is at zero angle, there is no fluid flow from pump unit 51, and the drive motors 37 will not rotate. After tilting of the swashplate in either direction, the control handle may be moved to vary the tilt angle, from maximum to zero, determining the speed of rotation of the drive motors 37. In a system 50, movement of the control handle to change direction and tilt angle of the swashplate, is precisely controlled by pneumatic components including a double-acting air cylinder 54 having a piston rod 55 connected to the control handle of the pump unit 51.

For further information as to the construction and operation of the known pump unit 51 and pump P and swashplate RSP, reference may be made to Bulletin 9565, Rev. J, August, 1980, and Bulletin 9630, Rev. E, October, 1980, published by Sundstrand Hydro-Transmission, Ames, Iowa 55010.

The pneumatic power source in the system 50 is a constant pressure pump indicated at 56. The air pump 56 is known in the art of pneumatic control and is mounted on the front of the truck 12, as convenient, for connection to the engine PTO 52.

The system 50 selectively conducts fluid under pressure from the pump unit 51 through bi-directional, supply or exhaust, piping 57A and 57B. The dual fluid pipes 57 may be run as convenient from the front of the truck 12, along the chassis and up through a rear corner of the truck deck 11. As determined by the position of the piston rod 55 of air cylinder 54, fluid under pressure from pipe 57A will always power either drum motor 37 for rotation in one direction. Or, fluid from pipe 57B will power either drum motor 37 for rotation in the opposite direction.

Above the truck deck 11, the dual pipes 57 are cross-connected through a lateral pipe section 58. The lateral pipe 58 has a known, open or closed, fluid control valve 59 manually actuated by a lever 60.

Above the lateral pipe section 58, the bi-directional pipes 57A and 57B communicate with a network of valved piping for selecting which drum, 30 or 31, is to be rotated. The rotation selection piping network has piping indicated by the prefix numeral 61, known, open or closed, fluid control valves indicated by the prefix numeral 62, and a manually actuated yoke and handle 63 for actuation of the valves 62 in unison.

Dual pipes 61/30 transmit fluid to a drum motor 37 for rotating the front winch drum 30. The dual pipes 61/30 are selectively opened or closed by dual control valves 62/30. Dual pipes 61/31 transmit fluid to a drum motor 37 for rotating the rear winch drum 31. The dual pipes 61/31 are selectively opened or closed by dual control valves 62/31.

The system 50 includes a control panel indicated generally by the numeral 70. The control panel is supplied with pneumatic power by piping 71 communicating with the engine driven constant pressure air pump 56. Within the body of the control panel, air from piping 71 is distributed by a manifold 72 communicating with two air pressure regulating valves, 73 and 74.

A regulating valve 73 actuated by a handle 75 is known in the art of pneumatic control. The valve 73 functions to vary the pressure of air in a supply line 76 communicating with a known in the art pneumatic actuator 77 for a throttle linkage 78 determining RPM of the truck engine 53. Manual actuation of the engine control handle 75 will determine the horsepower transmitted by engine 53 through PTO 52 to pump P of the pump unit 51. The horsepower applied controls the pressure of the fluid being transmitted from pump unit 51 and through the piping of system 50 toward the drive motors 37.

A regulating valve 74 actuated by a handle 80 is known in the art of pneumatic control. The valve 74 functions to vary the direction and pressure of air in dual supply lines 81 and 82 communicating with opposite sides of the piston within air cylinder 54. Manual actuation of the control handle 80 will determine the volume and direction of the fluid being transmitted from pump unit 51 and through the piping of system 50 toward the drive motors 37.

For further information as to the known valve 73 controlling the throttle actuator 77, and the valve 74 controlling the air cylinder 54, reference may be made to product literature published by Williams Air Control, Dana Corporation, Portland, Oreg. 97223. As of September, 1982, element 73 was a Williams part number 118542 valve controlling as element 77 Williams part number 117886 throttle actuator. Element 74 was a Williams part number 118552 valve controlling as element 54 a Williams part number 118459 control cylinder kit.

Figure 3:
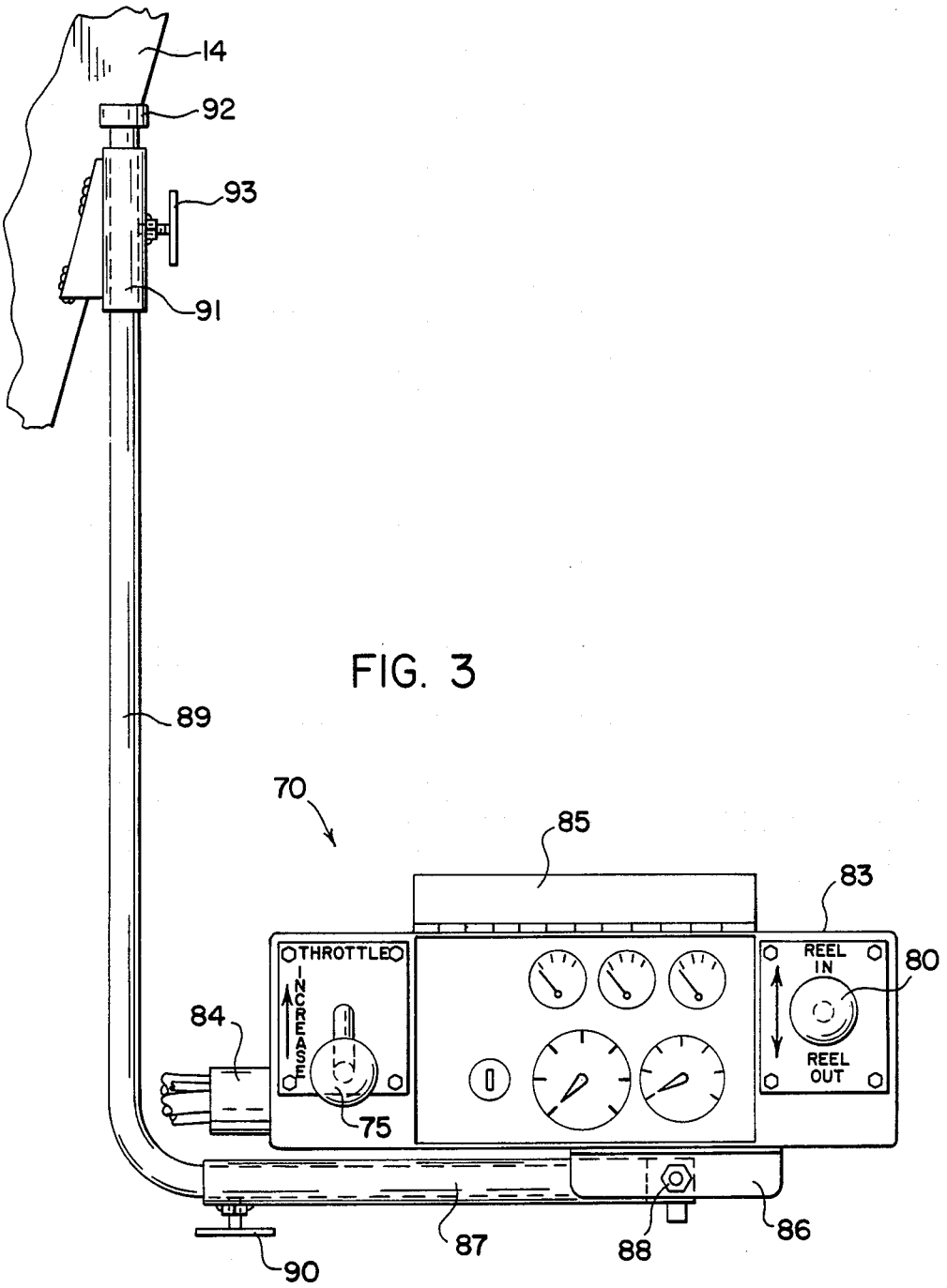
FIG. 3 is a plan view of a control panel according to the invention.

Referring to FIG. 3, a control panel 70 has a body case 83 for housing and mounting the valves 73 and 74 (not shown) and the control handles 75 and 80. The air lines 71, 76, 81 and 82 are bunched to enter the body case 83 through a weather-sealed fitting 84. Between the projecting control handles 75 and 80, the control panel can be fitted with various components relating to efficient and safe operation of the winch 10.

The top row of control instruments will indicate hydraulic oil temperature, truck water temperature and truck oil pressure. The bottom row (left to right) will have an engine ignition key, an engine tachometer and a hydraulic oil pressure gauge. When not being observed, the control instruments will be protected by a hinged case cover 85.

The underside of the control panel body case 83, carries a support bracket 86. The bracket 86 is removably attached to a laterally extending length of tubing 87, by a nut and handled bolt 88. The open end of support tube 87 is fitted coaxially around the laterally extending end of a swing arm 89. The control panel body case 83 is positioned horizontally by a locking handle 90.

The upper end of the control panel swing arm 89 is inserted into a bracket 91 securely attached to a mast stanchion 14. The swing arm 89 is retained in the bracket 91 by a stopcollar 92. The control body case 83 is positioned vertically or arcuately by a locking handle 93.

DESCRIPTION OF OPERATION AND USE

In FIG. 1, the truck 11 has been backed to the well casing 19. The mast 15 has been raised. The operator has adjusted the position of the control panel 70 (horizontally, vertically or arcuately) so that "working" of either the "sand line" 17 and "tubing cable" 18 and their tools or accessories, can be precisely and safely controlled. The operator will then use the control panel 70 to start the truck engine, build up hydraulic pressure in the pump unit 51 and check out the control instruments.

FIG. 4A shows how the operator will use the system 50 to raise or lower, reel in or reel out, "sand line" 17. The operator will grasp and move the yoke and handle 63 (up, as shown) to open dual control valves 62/30 and close dual control valves 62/31. If the operator intends to lower or reel out the "sand line" 17 into the well casing, the operator next moves the control handle 80 in a direction from off center (right, as shown) to retract the piston rod in the air cylinder 54. The swashplate RSP in the pump unit 51 will tilt from zero angle in a direction such that fluid under pressure will flow through pipe 57A (as shown by broken arrows) and a pipe 61/30 into the motor 37, to rotate drum 30 in the reel out direction (counterclockwise, as shown). Exhaust fluid from motor 37 will flow (as shown by broken arrows ) through a pipe 61/30 and pipe 57B into the pump unit 51.

To raise or reel in the "sand line" 17, the operator will move the control handle 80 in the opposite direction (left, as shown) to extend the piston rod in the air cylinder 54. The swashplate RSP in the pump unit 51 will tilt in the opposite direction, past zero angle, such that fluid under pressure will flow (as shown by full arrows) through pipe 57B and a pipe 61/30 into the motor 37 to rotate drum 30 in the reel in direction (clockwise, as shown). Exhaust fluid from motor 37 will flow (as shown by full arrows) through a pipe 61/30 and pipe 57A into the pump unit 51.

FIG. 4B shows how the operator will use the system 50 to raise or lower, reel in or reel out, "tubing cable" 18. The operator moves handle 63 (down, as shown) and opens dual control valves 62/31 closing dual control valves 62/30. Then, if the "tubing cable" is to be lowered into the well casing, the operator moves the control handle 80 in a direction from off center (right, as shown). To raise the "tubing cable", the operator moves the control handle 80 in the opposite direction (left, as shown).

When operating either the "sand line" 17 or the "tubing cable" 18, the ratio of lowering or raising is determined by operator adjustment of the control handle 80, toward or away from off center. If additional power is required to raise a loaded "sand line" or "tubing cable", the operator will advance the engine throttle control handle 75.

FIG. 4C shows how the operator will use the system 50 for free fall of either the "sand line" or "tubing cable" into the casing and bore of a relatively deep well. The operator pulls back the engine throttle control handle 75 reducing fluid pressure in the pump unit 51. The operator also moves the control handle 80 to the neutral or center position to center the piston rod in the air cylinder 54. The swashplate RSP will return to zero angle so that fluid under pressure does not flow into the pipes 57A or 57B toward the motors 37. The operator then selects the drum, 30 or 31, for free fall by moving the handle 63 (as shown, up for drum 30, down for drum 31). At this point, the selected drum will not begin to rotate because the system 50 is hydrostatically balanced or locked. The operator begins the free fall by moving the control lever 60 (up, as shown) to open valve 59 in the lateral pipe 58. The load or weight on either the "sand line" or "tubing cable" will rotate the drum, 30 or 31. Rotation of a drum will rotate the motor 37, generating an exhaust flow of fluid through pipes 61 and valves 62. The fluid flow will return to the motor 37 through the by-pass provided by the open lateral pipe 58. The closed loop path of fluid flow through a set of pipes 61 and valves 62, and out of and into a motor 37 will modulate and control the rate of free fall. When the operator determines the free fall stop, the control lever 60 is moved (down, as shown) to close valve 59 and restore hydrostatic balance to the system 50.

ALTERNATIVE EMBODIMENT

Although not shown herein, nor in U.S. Pat. No. 4,432,532, February, 1984, Overholt, a hydraulically powered direct drive dual drum line and cable winch could be made wherein each drum, 30 or 31, is driven by dual motors. In such an embodiment, an axle shaft mounted on the second side plate would be lengthened and converted to a drive shaft for rotation through a coupling by a hydraulic drive motor 37 mounted on a bell housing 34. It should be apparent that the embodiment of a system 50 disclosed herein could be readily modified to control operation and use of a tandem or "both end" drive for a drum 30 or 31. Such modification would require only additional pipes 61/30 and 61/31 above the control valves 62 and running to the added motors 37. It should further be apparent that a system 50 could be used to control the operation and use of a well tending rig which was not a "truck"; but rather a platform towed or hauled to a well casing 19. The engine 53 could be mounted on such platform. The pump unit 51 could be driven through the PTO 52, as convenient. Therefore, the scope of the invention should be determined solely by the claims as granted.

What is claimed is:

1. A system for operation and use of a dual drum line and cable winch mounted for use as a mobile well tending rig, each said drum being driven by a direct connected hydraulically powered motor, said system comprising:

a variable displacement, axial piston, reversing swashplate hydraulic pump unit powered by an engine;

a first actuator for controlling the horse power transmitted from said engine to said pump unit;

a second actuator for controlling the tilt angle and tilt direction of the swashplate in said pump unit;

dual fluid supply or exhaust piping running from said pump unit toward said dual drum drive motors;

a network of piping, with two pairs of open or closed fluid control valves, communicating with said dual fluid supply or exhaust piping, said network having two pairs of pipes, each said pipe pair connecting both of said fluid supply and exhaust pipes to one of said drum drive motors through one pair of said open or closed fluid control valves;

two-position control means for actuating all of said open or closed network control valves in unison so that as said pair of control valves in one said pipe pair are being opened, said pair of control valves in the other said pipe pair are being closed, or vice versa;

said dual fluid supply or exhaust piping being cross-connected through a lateral pipe section before reaching said two network pairs of pipes, said lateral pipe section having an open or closed fluid control valve, there also being a two-position control means for opening or closing said lateral pipe section control valve;

a first remote control means for said first actuator and a second remote control means for said second actuator;

whereby, a user of said system can select either of said drum drive motors to be powered by movement of said two-position control means for all of said network control valves in unison, can also control the direction of rotation for the selected drum drive motor by said second remote control means, can also control the power output from the selected drum drive motor by said first remote control means, and can also free fall the drum connected to the selected drum drive motor by movement of said two-position control means for opening or closing said lateral pipe section control valve.

2. A system according to claim 1 wherein a pneumatic pump supplies air to said first remote control means for movement of said first actuator.

3. A system according to claim 1 wherein said second actuator is an air cylinder and a pneumatic pump supplies air to said second remote control means for movement of a piston rod inside said air cylinder.

4. A system according to claim 1, wherein a control panel carries said first and second remote control means, said control panel having a body case, said body case being carried by and horizontally movable on a lower end of a swing arm, the upper end of said swing arm being carried by and rotatably and vertically movable with respect to a vertical member carried on said well tending rig, whereby the user may adjust the operating position of said control panel.

5. A system according to claim 4, wherein said control panel further carries a plurality of control instruments observable by the user during operation of said well tending rig.

* * * * *